US007254902B2

(12) United States Patent
Hayasaka et al.

(10) Patent No.: US 7,254,902 B2
(45) Date of Patent: Aug. 14, 2007

(54) SHEET DRYER

(75) Inventors: Tomoyuki Hayasaka, Ibaraki (JP); Satoshi Shibata, Ibaraki (JP)

(73) Assignee: Komori Corporation, Tokyo (JP)

( * ) Notice: Subject to any disclaimer, the term of this patent is extended or adjusted under 35 U.S.C. 154(b) by 356 days.

(21) Appl. No.: 11/107,024

(22) Filed: Apr. 14, 2005

(65) Prior Publication Data

US 2005/0236762 A1 Oct. 27, 2005

(30) Foreign Application Priority Data

Apr. 21, 2004 (JP) ..... 2004-125176

(51) Int. Cl.
*F26B 9/00* (2006.01)

(52) U.S. Cl. ..... 34/620; 34/266; 34/633; 34/649; 101/416.1; 118/312

(58) Field of Classification Search ..... 34/266, 34/620, 633, 649; 101/416.1, 424; 118/312, 118/326

See application file for complete search history.

(56) References Cited

U.S. PATENT DOCUMENTS 3,695,754 A * 10/1972 Washio et al. ..... 399/363
4,387,986 A * 6/1983 Tsuda et al. ..... 355/75
4,551,010 A * 11/1985 Miyashita et al. ..... 355/25
5,537,925 A * 7/1996 Secor et al. ..... 101/424.1
5,588,223 A * 12/1996 Marshall ..... 34/414
5,966,836 A * 10/1999 Valdez et al. ..... 34/448
6,088,930 A * 7/2000 Robin et al. ..... 34/267
6,143,074 A 11/2000 Komori

FOREIGN PATENT DOCUMENTS

EP 0870613 10/1998

* cited by examiner

*Primary Examiner*—S. Gravini
(74) *Attorney, Agent, or Firm*—Blakely Sokoloff Taylor & Zafman

(57) ABSTRACT

A sheet dryer includes sprockets and a delivery chain, at least one heat-resistant glass plate, at least one lower-surface drying lamp, a guide plate, a plurality of first discharge holes, and a plurality of second discharge holes. The sprockets and delivery chain convey a paper sheet along a convey path. The heat-resistant glass plate is arranged under the sheet convey path. The lower-surface drying lamp is arranged under the heat-resistant glass plate and dries the lower surface of the printed/coated paper sheet. The guide plate is arranged adjacent to the heat-resistant glass plate in a sheet convey direction. The first discharge holes are formed in the heat-resistant glass plate. Air is discharged upward through the first discharge holes. The second discharge holes are formed in the guide plate. Air is discharged through the second discharge holes in the widthwise direction of the paper sheet.

17 Claims, 13 Drawing Sheets

SHEET DRYER

BACKGROUND OF THE INVENTION

The present invention relates to a sheet dryer for drying a sheet which is printed or coated with varnish on its lower surface (reverse surface) and upper surface (obverse surface) or only on its lower surface.

In a conventional sheet dryer, as shown in U.S. Pat. No. 6,143,074, a pair of dryers which dry the two surfaces of a paper sheet are provided, between a printing unit and delivery unit, above and under a paper sheet conveyance path to sandwich it.

In the conventional sheet dryer described above, when a paper sheet coated with varnish or a printed paper sheet is to be conveyed, if the trailing edge of the paper sheet hangs to come into contact with the lower dryer, the vanish or ink applied to the lower surface of the paper sheet may be removed, or the lower surface of the paper sheet may be damaged.

SUMMARY OF THE INVENTION

It is an object of the present invention to provide a sheet dryer which prevents the varnish or ink on the lower surface of a sheet from being removed or the lower surface of the sheet from damage.

In order to achieve the above object, according to the present invention, there is provided a sheet dryer comprising convey means for conveying a sheet along a convey path, at least one transparent plate which is arranged under the sheet convey path, at least one lower-surface drying lamp which is arranged under the transparent plate and dries a lower surface of the printed/coated sheet, a guide plate which is arranged adjacent to the transparent plate in a sheet convey direction, a plurality of first discharge holes which are formed in the transparent plate and through which air is discharged upward, and a plurality of second discharge holes which are formed in the guide plate and through which air is discharged in a widthwise direction of the sheet.

DESCRIPTION OF THE PREFERRED EMBODIMENTS

A sheet dryer according to the first embodiment of the present invention will be described with reference to FIGS. 1 to 6.

Figure 1:
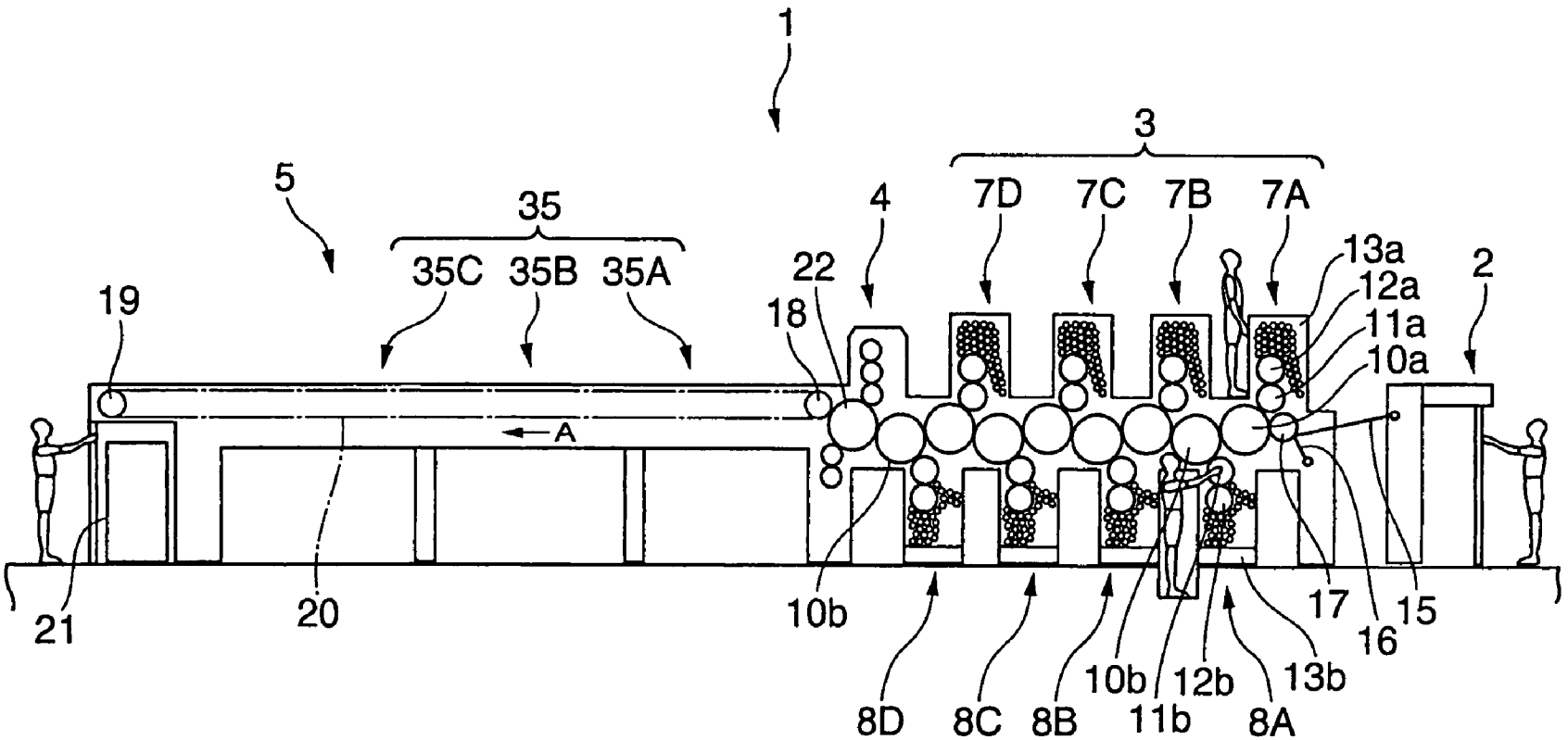
FIG. 1 is a side view of a sheet-fed offset rotary printing press to which a sheet dryer according to the present invention is applied.

Referring to FIG. 1, a sheet-fed offset rotary printing press 1 includes a feeder 2 which feeds a paper sheet, a printing unit 3 which prints on the fed paper sheet, a coating unit 4 which coats the upper surface (obverse surface) and lower surface (reverse surface) of the printed paper sheet with varnish, and a delivery unit 5 to which the coated paper sheet is delivered. The printing unit 3 has first to fourth upper-surface printing units 7A to 7D corresponding to four different ink colors, and first to fourth lower-surface printing units 8A to 8D corresponding to the four different ink colors. A feeder board 15 is provided between the feeder 2 and printing unit 3. A paper sheet fed onto the feeder board 15 from the printing unit 3 is fed to the printing unit 3 by a swing arm shaft gripper 16.

Each of the upper-surface printing units 7A to 7D includes a double-diameter impression cylinder 10*a* which has grippers on its outer surface to grip the paper sheet, a blanket cylinder 11*a* which is in contact with the upper portion of the impression cylinder 10*a*, a plate cylinder 12*a* which is in contact with the upper portion of the blanket cylinder 11*a*, and an inking unit 13*a* which supplies ink to the plate cylinder 12*a*.

Each of the lower-surface printing units 8A to 8D has a double-diameter impression cylinder 10*b* which has grippers on its outer surface to grip the paper sheet, a blanket cylinder 11*b* which is in contact with the lower portion of the impression cylinder 10*b*, a plate cylinder 12*b* which is in contact with the lower portion of the blanket cylinder 11*b*, and an inking unit 13*b* which supplies the ink to the plate cylinder 12*b*.

In this structure, the leading edge of the paper sheet fed from the feeder 2 to the feeder board 15 is gripped by the swing arm shaft gripper 16 and transferred to the grippers of the impression cylinder 10*a* of the first upper-surface printing unit 7A. When the paper sheet held by the impression cylinder 10*a* passes through the contact point between the impression cylinder 10*a* and blanket cylinder 11*a*, its upper surface is printed with the first color. Subsequently, the paper sheet which is printed on its upper surface with the first color is transferred to the impression cylinder 10*b* of the first lower-surface printing unit 8A. When the printed paper sheet passes through the contact point between the impression cylinder 10*b* and blanket cylinder 11*b*, the lower surface of the paper sheet is printed with the first color.

After that, the paper sheet is fed to the second to fourth upper-surface printing units 7B to 7D and second to fourth lower-surface printing units 8B to 8D, so that its upper and lower surfaces are printed with four different colors. The paper sheet is then coated with varnish on its upper and lower surfaces by the coating unit 4, as will be described later. The coated paper sheet is transferred to the delivery grippers of a delivery chain 20 extending between sprockets 18 and 19 provided before and after the delivery unit 5. The paper sheet conveyed by the delivery chain 20 falls onto a delivery pile 21 and is stacked on it.

Figure 2:
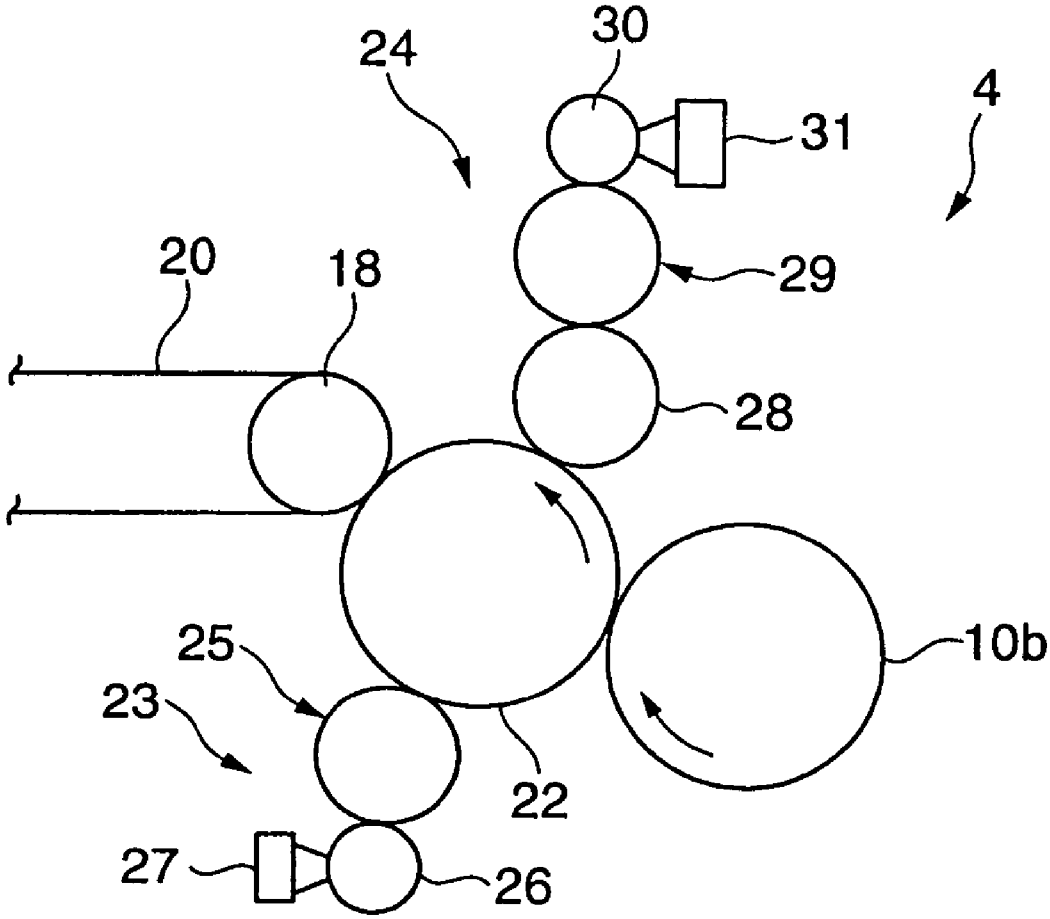
FIG. 2 is a view showing the cylinder arrangement of a coating device in the sheet-fed offset rotary printing press to which the sheet dryer according to the present invention is applied.

The coating unit 4 will be described with reference to FIG. 2. As shown in FIG. 2, the coating unit 4 includes a blanket cylinder 22 which is in contact with the impression cylinder 10*b* of the fourth lower-surface printing unit 8D, a varnish coating device 23 which coats the lower surface of the printed paper sheet, and a varnish coating device 24 which coats the upper surface of the printed paper sheet.

The varnish coating device 23 includes a varnish film forming cylinder 25 which is in contact with the blanket cylinder 22 on a side more upstream of the contact point between the blanket cylinder 22 and impression cylinder 10*b* in the sheet convey direction, an anilox roller 26 which is in contact with the varnish film forming cylinder 25, and a chamber coater 27 which supplies the varnish to the anilox roller 26. The varnish supplied from the chamber coater 27 to the anilox roller 26 is transferred to the outer surface of the blanket cylinder 22 through the varnish film forming cylinder 25.

The varnish coating device 24 includes a varnish film forming cylinder 28 which is in contact with the blanket cylinder 22 on a side more downstream of the contact point between the blanket cylinder 22 and impression cylinder 10*b* in the sheet convey direction, an anilox roller 30 which is in contact with the varnish film forming cylinder 29, and a chamber coater 31 which supplies the varnish to the anilox roller 30.

The varnish supplied from the chamber coater 31 to the anilox roller 30 is transferred to the blanket cylinder 28 through the varnish film forming cylinder 29, to coat the upper surface of the printed paper sheet which passes through the contact point between the blanket cylinder 28 and blanket cylinder 22. At this time, the varnish which is transferred from the varnish film forming cylinder 25 of the varnish coating device 23 described above to the outer surface of the blanket cylinder 22 is simultaneously applied to the lower surface of the printed paper sheet.

A drying device 35 will be described with reference to FIGS. 3A to 9.

As shown in FIG. 1, in the delivery unit 5, the drying device 35 which dries the upper and lower surfaces of the paper sheet is arranged between the coating unit 4 and delivery pile 21. The drying device 35 includes first to third dryers 35A, 35B, and 35C sequentially located from the upstream side to the downstream side in the sheet convey direction (direction of an arrow A).

Figure 3A:
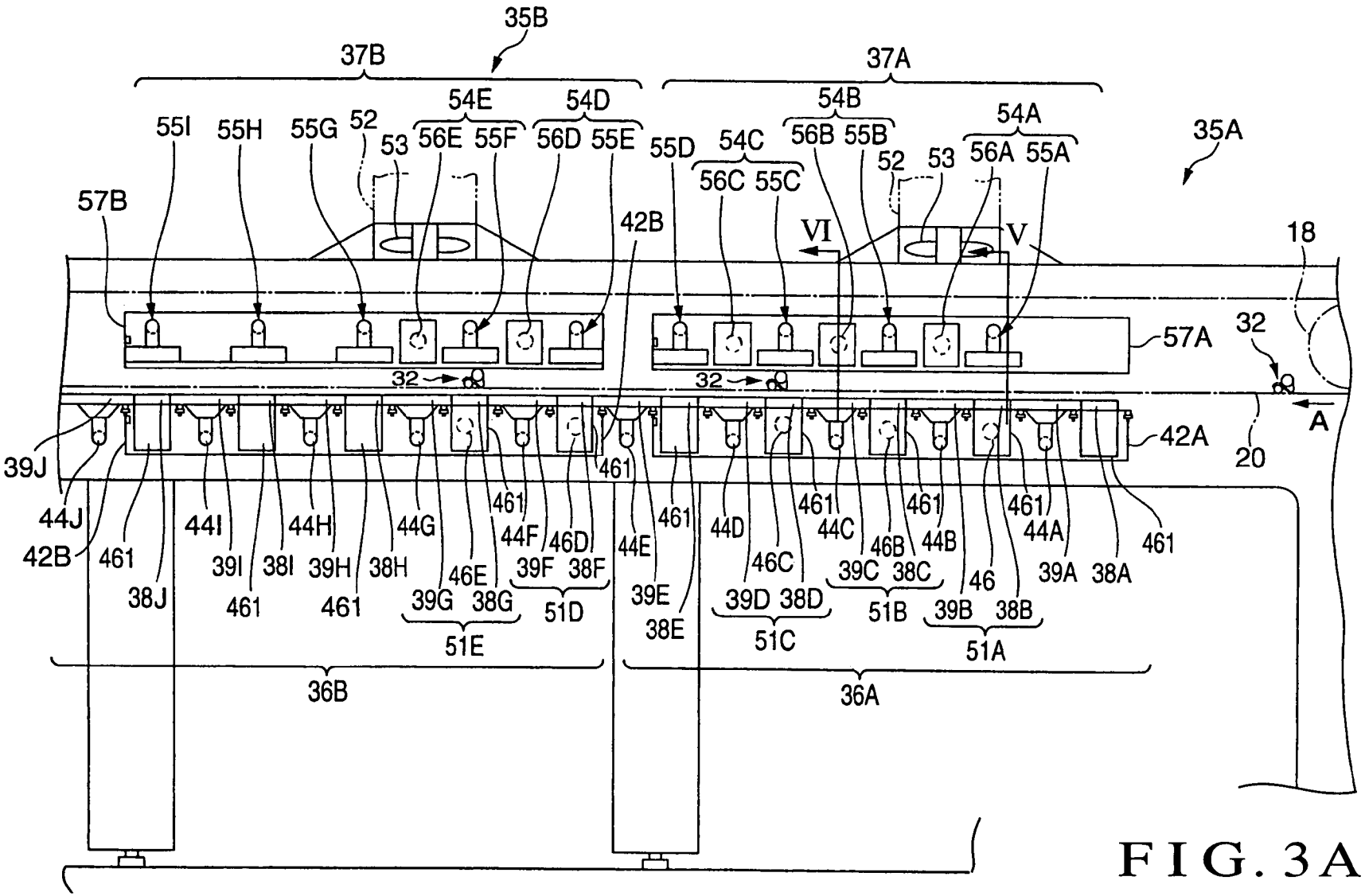
FIGS. 3A and 3B are side views showing the upstream and downstream halves, respectively of a sheet dryer according to the first embodiment of the present invention.

As shown in FIG. 3A, the first dryer 35A includes a lower-surface dryer 36A which is arranged under the delivery chain 20, serving as the sheet convey path, with its heater surface facing upward to dry the varnish applied to the lower surface of the paper sheet, and an upper-surface dryer 37A which is arranged above the delivery chain 20 with its heater surface facing downward to dry the varnish applied to the upper surface of the paper sheet.

The lower-surface dryer 36A constituting the first dryer 35A has five heat-resistant glass plates 38A to 38E which are formed of transparent plates arranged at predetermined intervals from the upstream side to the downstream side in the sheet convey direction, and five metal guide plates 39A to 39E which are positioned downstream of the corresponding heat-resistant glass plates in the sheet convey direction.

The heat-resistant glass plates 38A to 38E and guide plates 39A to 39E will be described. The heat-resistant glass plates 38A to 38E have the same structure and the guide plates 39A to 39E have the same structure, and accordingly they will be described exemplifying the heat-resistant glass plate 38C and the guide plates 39B and 39C in FIG. 4.

Figure 4:
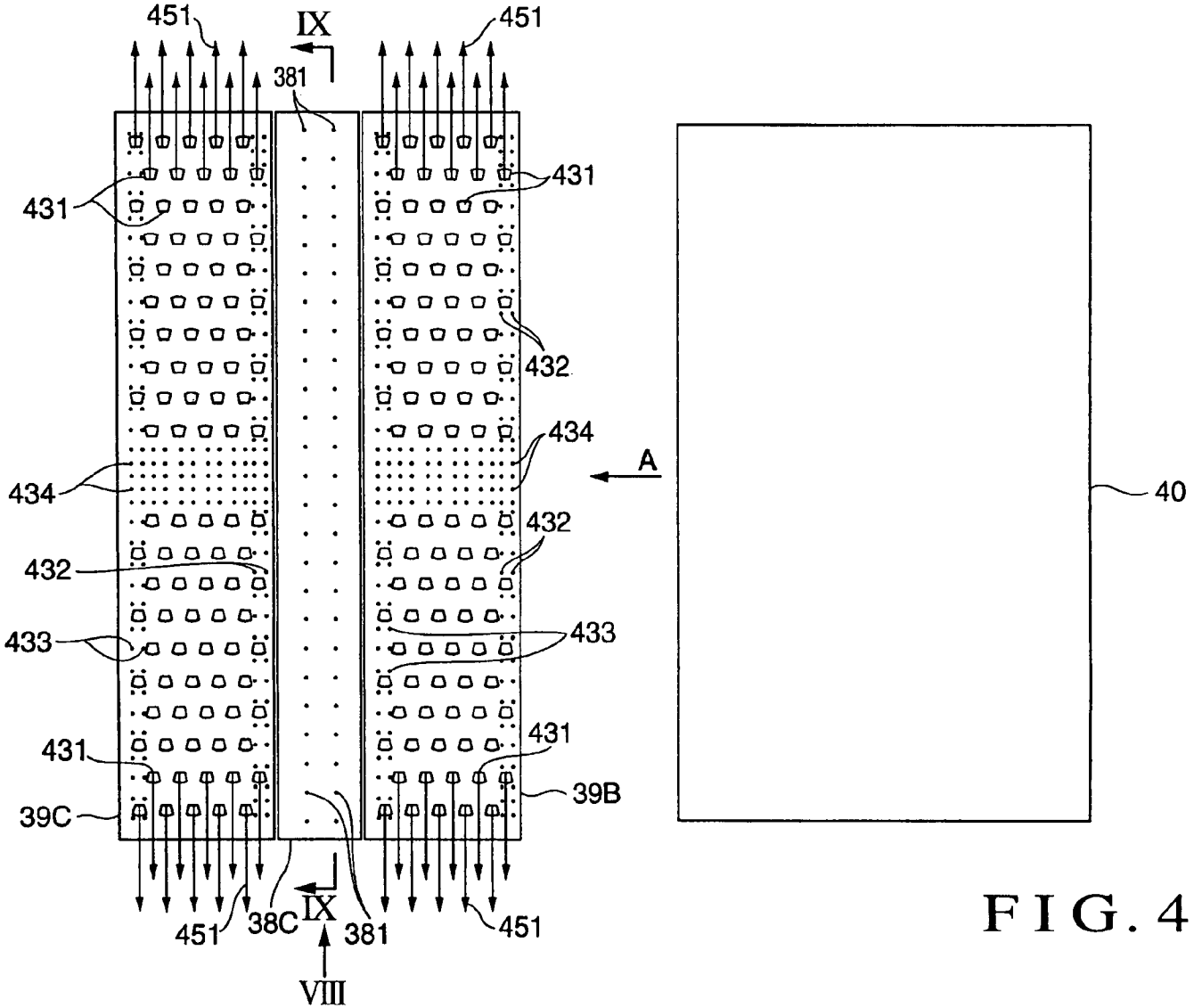
FIG. 4 is a plan view of a transparent plate and guide plates shown in FIGS. 3A and 3B.
Figure 8:
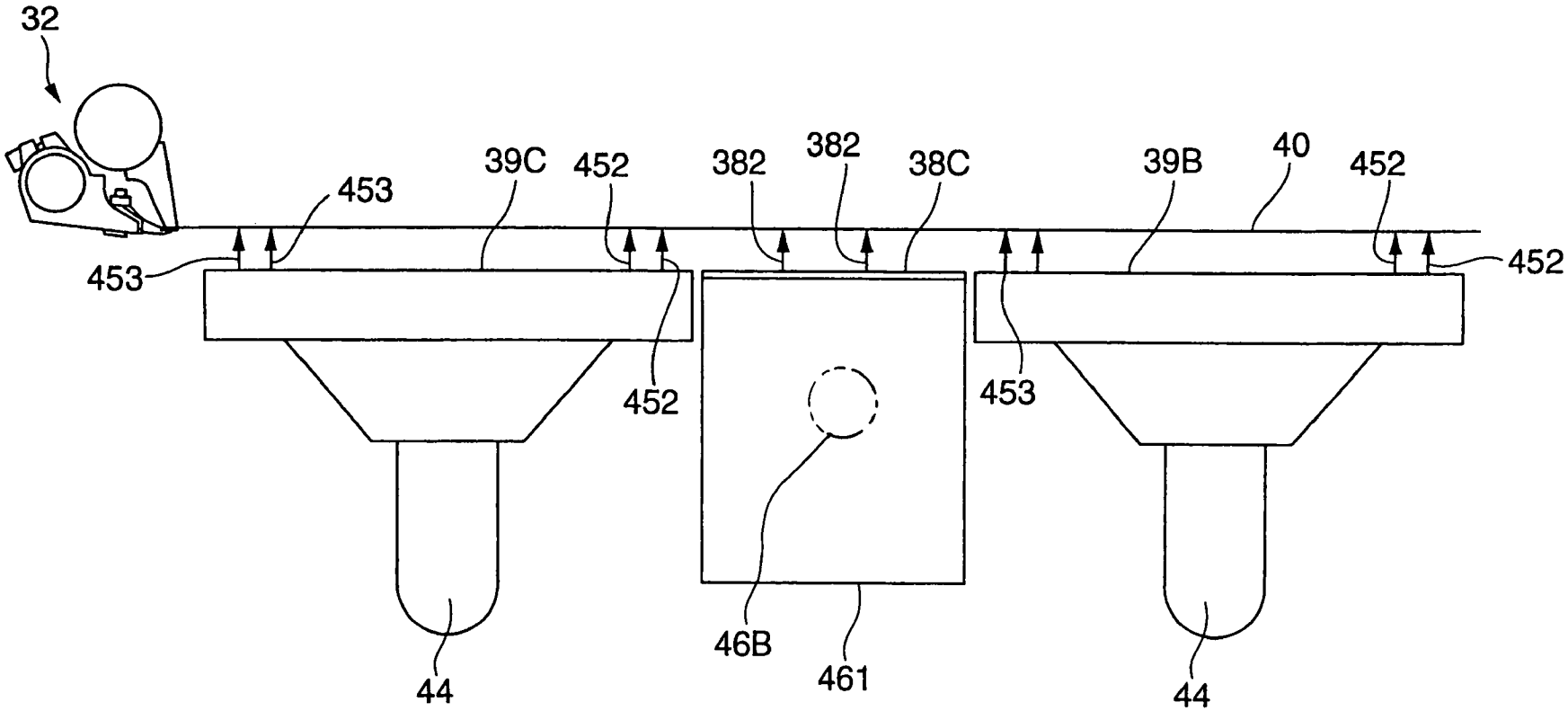
FIG. 8 is a view seen from the direction of an arrow VIII of FIG. 4.

As shown in FIG. 4, each of the heat-resistant glass plate 38C and guide plates 39B and 39C is a thin rectangle to be slightly longer in a direction perpendicular to the sheet convey direction (the direction of the arrow A) than the width of the paper sheet 40. The heat-resistant glass plate 38C and guide plates 39B and 39C are attached between a pair of frames 41 (FIG. 5) through support members 42A (FIG. 3A) such that the two end faces of the heat-resistant glass plate 38C and the corresponding end faces of the adjacent guide plates 39B and 39C oppose each other through small gaps, as shown in FIG. 8. The heat-resistant glass plate 38C and guide plates 39B and 39C are arranged such that their upper surfaces form one plane parallel to the traveling direction (the direction of the arrow A) of the delivery chain 20.

As shown in FIG. 3A, lower-surface drying lamps 46A to 46C formed of infrared lamps are arranged under the three heat-resistant glass plates 38B to 38D to exclude the two heat-resistant glass plates at the two ends in the sheet convey direction. The lower-surface drying lamps 46A to 46C are accommodated in corresponding chambers 461. Under the two heat-resistant glass plates 38A and 38E located at the two ends in the sheet convey direction, no lower-surface drying lamps are arranged, but only chambers 461 are arranged. The five chambers 461 are disposed in the lower-surface dryer 36A to correspond to the five heat-resistant glass plates 38A to 38E. As shown in FIG. 4, the heat-resistant glass plates 38A to 38E have a large number of discharge holes 381 through which room-temperature air which is supplied into the chambers 461 through air supply pipes (to be described later) is discharged.

Figure 9:
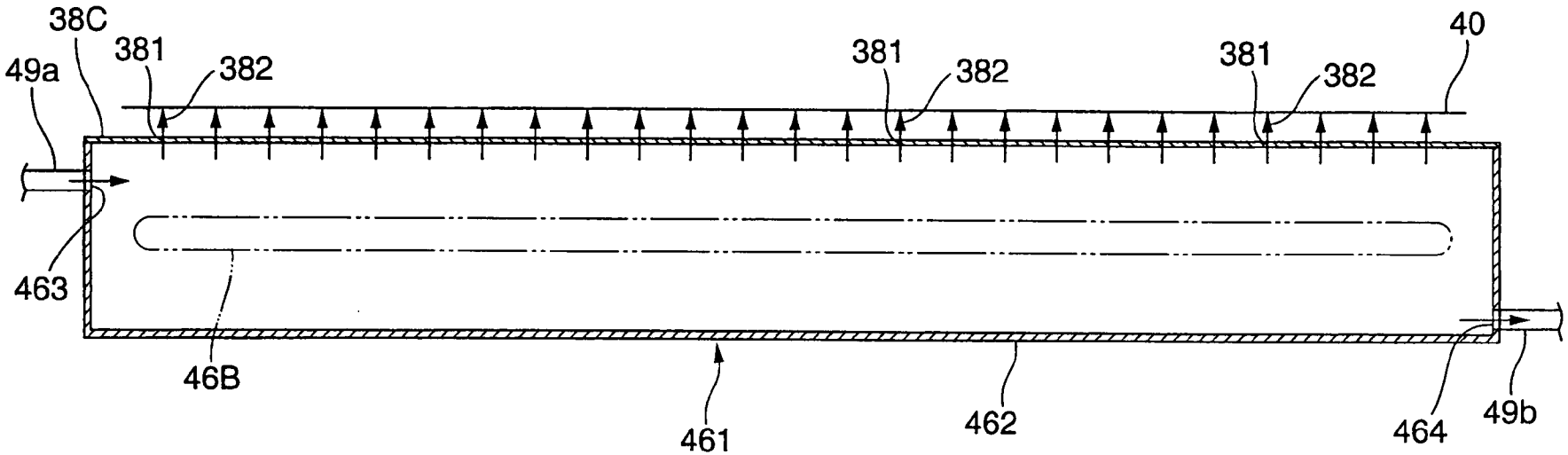
FIG. 9 is a sectional view taken along the line IX-IX of FIG. 4.

A box 462 having an upper opening as shown in FIG. 9 is arranged under each of the heat-resistant glass plates 38A to 38E. Each chamber 461 includes one box 462 and a corresponding one of the heat-resistant glass plates 38A to 38E which is attached to cover the opening of the box 462. The box 462 has an air supply port 463 and exhaust port 464 respectively formed in a pair of walls parallel to the sheet convey direction. The air supply port 463 is connected to an air supply pipe 49*a*, and the exhaust port 464 is connected to an exhaust pipe 49*b*. Air 382 supplied into the chambers 461 from the air supply pipe 49*a* cools the corresponding infrared lamp 46 and is discharged upward from the discharge holes 381.

As shown in FIG. 4, each of the guide plates 39A to 39E has a large number of discharge holes 431 which are formed throughout the entire portion, discharge holes 432 and 433 respectively formed in the two side regions close to the adjacent heat-resistant glass plates, and discharge holes 434 formed at the central region in the widthwise direction of the paper sheet 40. Air supplied from corresponding ducts 44 is discharged through the discharge holes 431, 432, 433, and 434. Five ducts 44A to 44E are disposed in the lower-surface dryer 36A to correspond to the guide plates 39A to 39E.

Figure 7A:
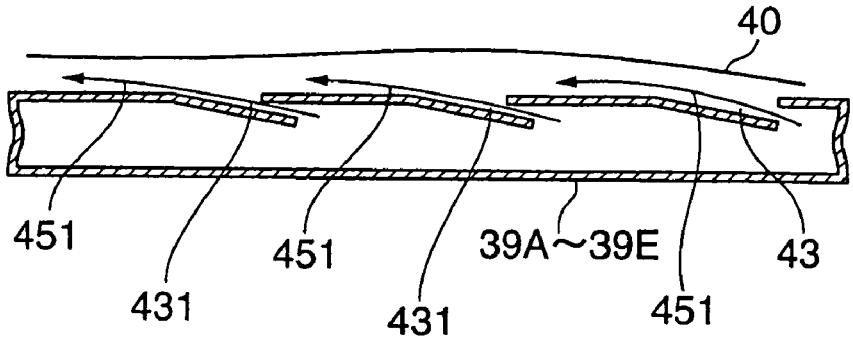
FIG. 7A shows a state wherein air is discharged from discharge holes in the guide plate.

Air 451 from the discharge holes 431, of the discharge holes 431, 432, 433, and 434, is directed in the widthwise direction of the paper sheet 40, as shown in FIG. 4, and discharged to flow along the lower surface of the conveyed paper sheet 40, as shown in FIG. 7A. More specifically, the air 451 from the discharge holes 431 which are close to the right side in the sheet convey direction is discharged rightward from the central portion, and the air 451 from the discharge holes 431 which are close to the left side in the sheet convey direction is discharged leftward from the central portion. Air 452 and air 453 from the discharge holes 432, 433, and 434 are discharged upward, as shown in FIG. 8.

As shown in FIG. 3A, the set of the second heat-resistant glass plate 38B from the upstream side in the sheet convey direction and the guide plate 39B continuous to it, and the lower-surface drying lamp 46A accommodated in the chamber 461 corresponding to the heat-resistant glass plate 38B form a first lower-surface drying unit 51A. The set of the third heat-resistant glass plate 38C from the upstream side in the sheet convey direction and the guide plate 39C continuous to it, and the lower-surface drying lamp 46B accommodated in the chamber 461 corresponding to the heat-resistant glass plate 38C form a second lower-surface drying unit 51B. The set of the fourth heat-resistant glass plate 38D from the upstream side in the sheet convey direction and the guide plate 39D continuous to it, and the lower-surface drying lamp 46C accommodated in the chamber 461 corresponding to the heat-resistant glass plate 38D form a third lower-surface drying unit 51C.

Figure 6:
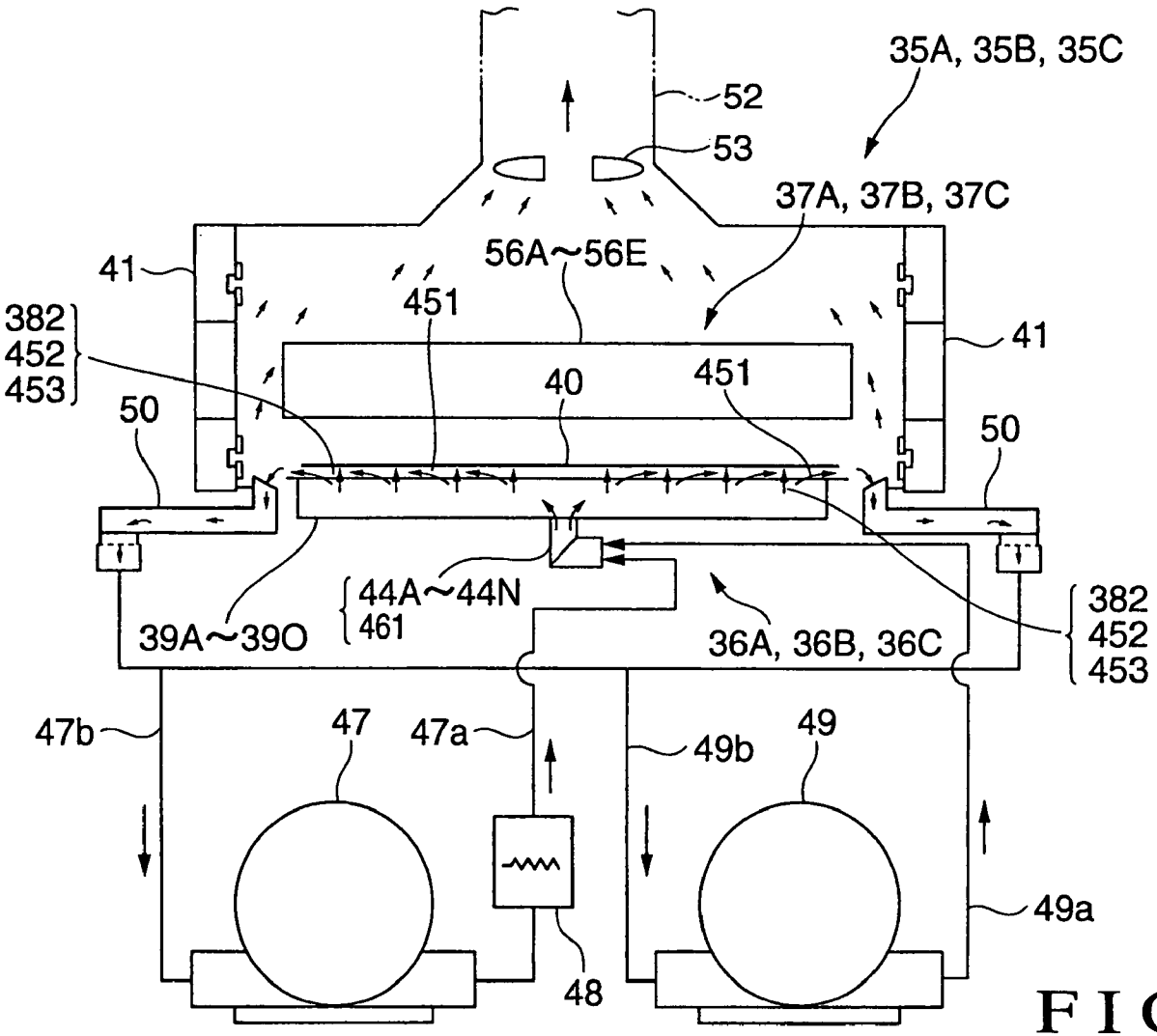
FIG. 6 is a view seen from the direction of an arrow VI of FIG. 3A.

Referring to FIG. 6, a lower-surface blower 47 is connected through an air supply pipe 47*a* to the four ducts 44A, 44B, 44D, and 44E except the duct 44C at the center in the sheet convey direction. Air to pass through the air supply pipe 47*a* is heated by a heater 48. Accordingly, warm air is supplied from the lower-surface blower 47 to the four ducts 44A, 44B, 44D, and 44E. Thus, the warm air 451, warm air 452, and warm air 453 are discharged from the discharge holes 431, 432, 433, and 434 in the four guide plates 39A, 39B, 39D, and 39E except the guide plate 39C at the center in the sheet convey direction.

A lower-surface blower 49 is connected through an air supply pipe 49*a* to the duct 44C at the center in the sheet convey direction and the five chambers 461 of the upper-surface dryer 37A to supply room-temperature air. The lower-surface blower 49 supplies room-temperature air to all the chambers of lower-surface dryers 36B and 36C (to be described later).

As shown in FIG. 6, exhaust ducts 50 are arranged in the vicinities of the two ends in the sheet convey direction of the guide plates 39A to 38E, and connected to the lower-surface blowers 47 and 48 through an exhaust pipe 47*b* and exhaust pipe 49*b*. As shown in FIGS. 3A and 6, exhaust ducts 52 are arranged above the convey path 20 of the paper sheet 40. Air discharged into the convey path 20 is discharged by fans 53 through the exhaust ducts 52.

The upper-surface dryer 37A will be described. The upper-surface dryer 37A which is arranged above the convey path 20 of the paper sheet 40 to oppose the lower-surface dryer 36A has four upper-surface air blowing devices 55A to 55D and three upper-surface drying lamps 56A to 56C which are formed of infrared lamps and arranged alternately with the upper-surface air blowing devices in the sheet convey direction. The upper-surface air blowing devices 55A to 55D and upper-surface drying lamps 56A to 56C are attached between the pair of frames 41 through support members 57A.

The upper-surface air blowing devices 55A to 55D are arranged to oppose the heat-resistant glass plates 38B to 38E of the lower-surface dryer 36A. The upper-surface drying lamps 56A to 56C are arranged to oppose the guide plates 39B to 39D of the lower-surface dryer 36A.

When seen from the upstream side in the sheet convey direction, the set of the upper-surface air blowing device 55A and the upper-surface drying lamp 56A continuous to it form a first upper-surface drying unit 54A. The upper-surface drying unit 54A opposes the lower-surface drying unit 51A of the lower-surface dryer 36A. The upper-surface air blowing device 55B and the upper-surface drying lamp 56B continuous to it form a second upper-surface drying unit 54B. The upper-surface drying unit 54B opposes the lower-surface drying unit 51B of the lower-surface dryer 36A. The upper-surface air blowing device 55C and the upper-surface drying lamp 56C continuous to it form a third upper-surface drying unit 54C. The upper-surface drying unit 54C opposes the lower-surface drying unit 51C of the lower-surface dryer 36A.

Figure 5:
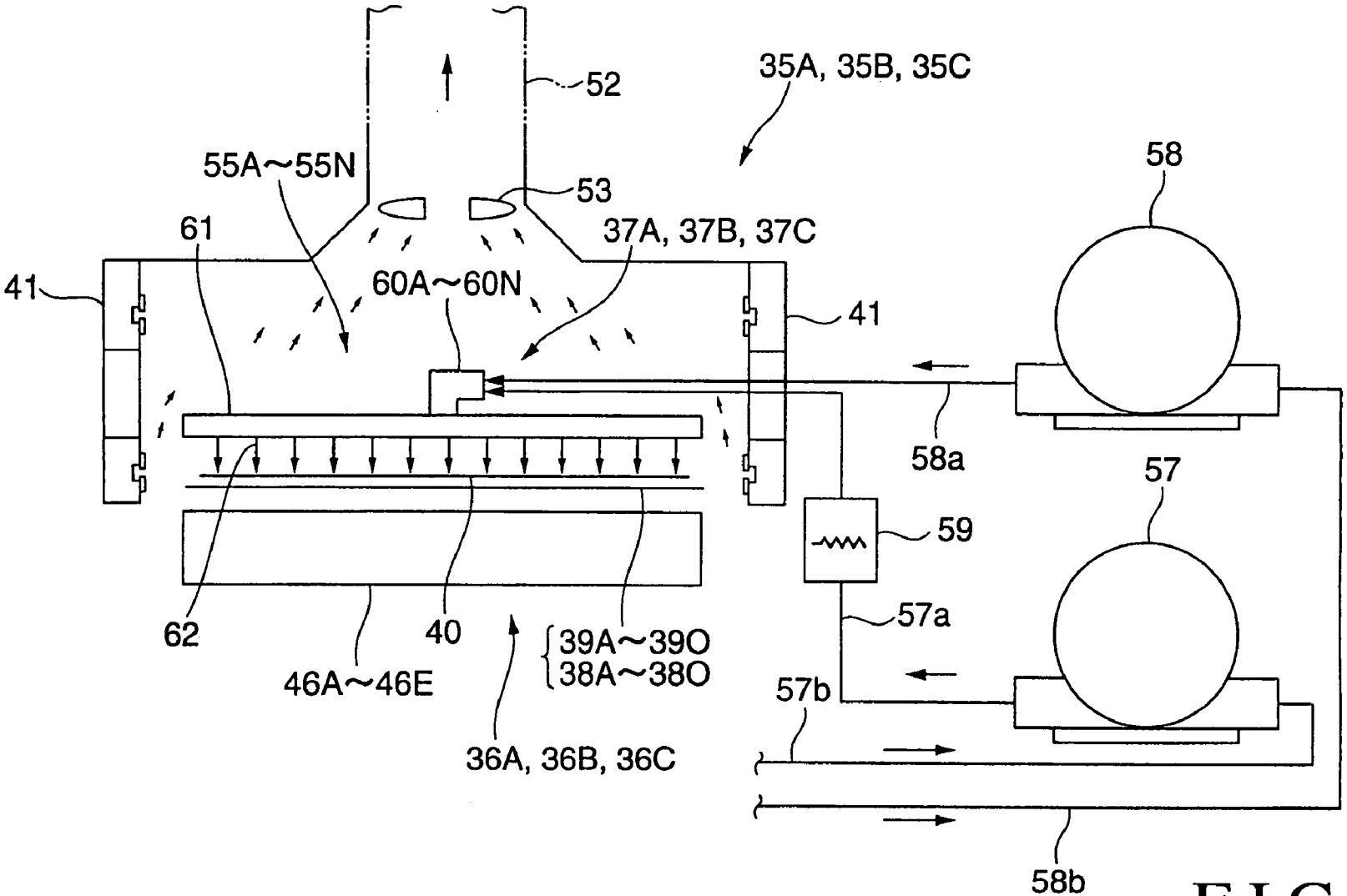
FIG. 5 is a view seen from the direction of an arrow V of FIG. 3A.

As shown in FIG. 5, the upper-surface air blowing devices 55A to 55D include ducts 60A to 60D to which air is supplied from upper-surface blowers 57 and 58, and a large number of nozzles 61 through which air 62 supplied to the ducts 60A to 60D is blown to the entire upper surface of the paper sheet 40 in the convey path 20 from above. The ducts 60A to 60D are provided to correspond to the respective upper-surface air blowing devices 55A to 55D. Each of the upper-surface air blowing devices 55A to 55D has a large number of nozzles 61.

The upper-surface blower 57 is connected through an air supply pipe 57*a* to the ducts 60A, 60B, and 60D of the first, second, and fourth upper-surface air blowing devices 55A, 55B, and 55D from the upstream side in the sheet convey direction. Room-temperature air passing through the air supply pipe 57*a* is heated by a heater 59. Accordingly, warm air is supplied from the upper-surface blower 57 to the ducts 60A, 60B, and 60D.

The upper-surface blower 58 is connected through an air supply pipe 58*a* to the duct 60C of the third upper-surface air blowing device 55C to supply room-temperature air. An exhaust pipe 57*b* of the upper-surface blower 57 and an exhaust pipe 58*b* of the upper-surface blower 58 are connected to the exhaust ducts 50.

The operation of drying the two coated surfaces of the paper sheet by the first dryer 35A having the above structure will be described. Referring to FIG. 2, the paper sheet, the upper and lower surfaces of which have been coated, is transferred from the grippers of the blanket cylinder 22, which forms the coating unit 4, to delivery grippers 32 of the delivery chain 20, conveyed in the direction of the arrow A shown in FIG. 3A, and guided into the first dryer 35A.

In the first dryer 35A, the air 451 discharged from the discharge holes 431 in the guide plates 39A to 39E which form the lower-surface dryer 36A flows in the widthwise direction of the paper sheet 40 along the lower surface of the paper sheet 40, as shown in FIG. 7A. Simultaneously, the air 62 from the upper-surface air blowing devices 55A to 55D of the upper-surface dryer 37A is blown to the entire upper surface of the paper sheet 40 from above. As the air 451 passes to flow along the lower surface of the paper sheet 40 and the air 62 is blown to the entire upper surface of the paper sheet 40 in this manner, the paper sheet 40 is conveyed as it is levitated from the guide plates 39A to 39E.

As shown in FIG. 7A, the air 451 from the discharge holes 431 in the guide plates 39A to 39E is discharged to flow along the lower surface of the paper sheet 40 and passes along the upper surfaces of the guide plates 39A to 39E. At this time, the faster the wind velocity of the air 451, the lower the pressure, and the pressure above the guide plates 39A to 39E decreases from the Bernoulli theorem expressed by equation (1):

$$v^2/2g+p/\gamma=\text{constant} \quad (1)$$

where v is the wind velocity and p is the pressure. Consequently, the paper sheet 40 located above the guide plates 39A to 39E is attached to the guide plates 39A to 39E.

Figure 7B:
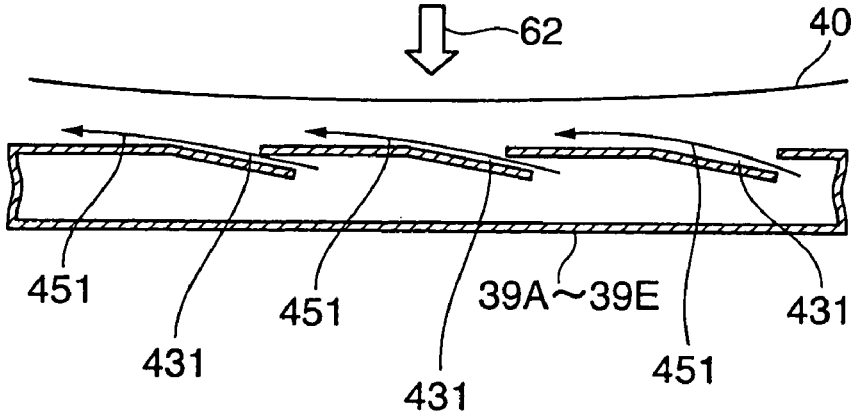
FIG. 7B shows a state wherein air discharged from the discharge holes in the guide plate passes below a paper sheet and air is blown from an upper-surface air blowing device to the upper surface of the paper sheet.

In this state, as shown in FIG. 7B, when the paper sheet 40 is pressed from above to come further closer to the guide plates 39A to 39E, the channel of the air 451 formed between the paper sheet 40 and the upper surfaces of the guide plates 39A to 39E becomes narrow. Thus, the pneumatic pressure in the channel increases to generate a force that moves the paper sheet 40 upward. When the air 62 from the upper-surface air blowing devices 55A to 55D of the upper-surface dryer 37A is blown to the paper sheet 40 from above, the paper sheet 40 is conveyed as it is levitated from the guide plates 39A to 39D at a predetermined gap without coming into contact with them.

The air 451 which is discharged from the discharge holes 431 in the guide plates 39A to 39E and flows out in the widthwise direction of the paper sheet 40 is released from the two ends in the widthwise direction of the paper sheet 40, drawn in the exhaust ducts 50, and exhausted, as shown in FIG. 6. Part of the air 451 is exhausted from the upper exhaust ducts 52. In this manner, since the air 451 is released from the two ends in the widthwise direction of the paper sheet 40, it will not stay between the paper sheet 40 and the guide plates 39A to 39E. As a result, the paper sheet 40 is conveyed as it is held levitated at a predetermined height from the guide plates 39A to 39E.

As the air 382 is discharged upward from the discharge holes 381 in the heat-resistant glass plates 38A to 38E, the paper sheet 40 is lifted by the air 382 and conveyed as it is held levitated at a predetermined height from the guide plates 39A to 39E. Thus, the paper sheet 40 does not flap vertically, and its trailing edge is prevented from coming into contact with the heat-resistant glass plates 38A to 38E. Therefore, while the paper sheet 40 is being conveyed in the first dryer 35A, the varnish applied to the lower surface of the paper sheet 40 can be prevented from being removed, or the lower surface of the paper sheet 40 can be prevented from being damaged.

The air 62 blown from air supply ducts 61A to 61D of the upper-surface air blowing devices 55A to 55D is exhausted through the upper exhaust ducts 52 and the exhaust ducts 50 which are located in the widthwise direction.

The air 452 and air 453 are discharged upward from the discharge holes 432 and 433 formed in those regions of the guide plates 39A to 39E which are adjacent to the heat-resistant glass plates 38A to 38E. In spite that a gap is formed between the heat-resistant glass plates 38A to 38E and the guide plates 39A to 39E, since the paper sheet 40 is lifted by the air 452 and air 453, its trailing edge is prevented from coming contact with the guide plates 39A to 39E or the heat-resistant glass plates 38A to 38E. At the central portions of the guide plates 39A to 39E where air from the discharge holes 431 does not flow, air is discharged upward from the discharge holes 434. Therefore, the central portion of the paper sheet 40 is prevented from coming into contact with the guide plates 39A to 39E.

The air 451 discharged from the discharge holes 431 in the guide plates 39A to 39E flows in the widthwise direction of the paper sheet 40 and does not toward the heat-resistant glass plates. Therefore, an air flow that crosses between the guide plates 39A to 39E and heat-resistant glass plates 38A to 38E is not generated. Even if a step is present between the upper surfaces of the heat-resistant glass plates 38A to 38E and the upper surfaces of the adjacent guide plates 39A to 39E, no turbulence is generated between them. Therefore, the paper sheet 40 does not flap vertically, and its trailing edge can be prevented from coming into contact with the guide plates 39A to 39E or heat-resistant glass plates 38A to 38E. As a result, damage to the paper sheet 40 or varnish removal from the paper sheet 40 can be prevented.

Infrared rays from the lower-surface drying lamps 46A to 47C of the first to third lower-surface drying units 51A to 51C irradiate the lower surface of the paper sheet 40 which is being conveyed in the first dryer 35A in this manner, to promote drying the lower surface of the paper sheet 40. Simultaneously, the warm air 451, warm air 452, and warm air 453 discharged from the discharge holes 431, 432, 433, and 434 in the first and second guide plates 39A and 39B, which are arranged on the upstream side in the convey direction of the paper sheet 40, also dry the lower surface of the paper sheet 40.

The upper-surface drying lamps 56A and 56C are arranged to oppose the second and fourth guide plates 39B and 39D. The guide plates 39B and 39D heated by the upper-surface drying lamps 56A and 56C also promote drying the lower surface of the paper sheet 40.

After the lower surface of the paper sheet 40 is irradiated with the infrared rays from the lower-surface drying lamps 46A to 46C and blown by the warm air 451, warm air 452, and warm air 453, it is blown by the room-temperature air 451 to room-temperature air 453 from the discharge holes 431 to 434 in the third guide plate 39C. This cools the lower surface of the paper sheet 40 to prevent hardening of the paper sheet 40 due to excessive heat to the lower surface of the paper sheet 40 and hardening of the ink or varnish applied to the paper sheet 40.

If a non-dry portion is left on the lower surface of the paper sheet 40 that has passed by the third guide plate 39C, it is dried by the warm air 451, warm air 452, and warm air 453 discharged from the discharge holes 431 to 434 in the fourth and fifth guide plates 39D and 39E.

The upper surface of the paper sheet 40 which is being conveyed in the first dryer 35A is irradiated with infrared rays from the three upper-surface drying lamps 56A to 56C, so that drying of the lower surface of the paper sheet 40 is promoted. Simultaneously, the warm air 62 blown by the first and second upper-surface air blowing devices 55A and 55B, which are arranged on the upstream side in the convey direction of the paper sheet 40, also dries the upper surface of the paper sheet 40.

After the upper surface of the paper sheet 40 is irradiated with the infrared rays from the lower-surface drying lamps 56A to 56C and blown by warm air 62A and warm air 62B in this manner, it is simultaneously blown by room-temperature air 62C from the third upper-surface air blowing device 55C. This cools the upper surface of the paper sheet 40 to prevent hardening of the paper sheet 40 due to excessive heat to the upper surface of the paper sheet 40 and hardening of the ink or varnish applied to the paper sheet 40.

If a non-dry portion is left on the upper surface of the paper sheet 40 that has passed under the third upper-surface drying lamp 56C, it is dried by warm air 62D blown from the fourth upper-surface air blowing device 55D. In the lower-surface dryer 36A of the first dryer 35A, if necessary, lower-surface drying lamps may be arranged in the first and fifth chambers 461 from the upstream side in the convey direction of the paper sheet 40.

The second dryer 35B will be described with reference to FIG. 3A.

The second drying device 35B includes a lower-surface dryer 36B which is arranged under the convey path 20 of the paper sheet 40, and an upper-surface dryer 37B which is arranged above the convey path 20 of the paper sheet 40 to oppose the lower-surface dryer 36B.

The lower-surface dryer 36B includes five heat-resistant glass plates 38F to 38J and five metal guide plates 39F to 39J which are arranged alternately in the convey direction (the direction of the arrow A) of the paper sheet 40, two lower-surface drying lamps 46D and 46E which are respectively arranged under the first and second heat-resistant glass plates 38F and 38G from the upstream side in the convey direction of the paper sheet 40, and five ducts 44F to 44F which supply air to the guide plates 39F to 39J.

The five heat-resistant glass plates 38F to 38J, five guide plates 39F to 39J, and two lower-surface drying lamps 46D and 46E are attached between the pair of frames 41 through support members 42B. Warm air from the lower-surface blower 47 is supplied from the second duct 44, and room-temperature air is supplied from the lower-surface blower 49 to the remaining ducts 44F and 44H to 44J.

When seen from the upstream side in the sheet convey direction, the lower-surface drying lamp 46D, heat-resistant glass plate 38F, and guide plate 39F form a first lower-surface drying unit 51D. The lower-surface drying lamp 46E, heat-resistant glass plate 38G, and guide plate 39G form a second lower-surface drying unit 51E. In the upper-surface dryer 37B, upper-surface drying lamps 56D and 56E formed of two infrared lamps, and five upper-surface air blowing devices 55E to 55I are attached between the pair of frames 41 through support members 57B.

The two upper-surface drying lamps 56D and 56E respectively oppose the first and second guide plates 39F and 39G of the lower-surface dryer 36B described above. The five upper-surface air blowing devices 55E to 55I respectively oppose the heat-resistant glass plates 38F to 38J of the lower-surface dryer 36B. Warm air from the upper-surface blower 57 is supplied to the second upper-surface air blowing device 55F. Room-temperature air is supplied from the upper-surface blower 58 to the remaining upper-surface air blowing devices 55E and 55G to 55I.

When seen from the upstream side in the sheet convey direction, the upper-surface air blowing device 55E and upper-surface drying lamp 56D form a first upper-surface drying unit 54D. The upper-surface drying unit 54D opposes the first lower-surface drying unit 51D of the lower-surface dryer 36B. The upper-surface air blowing device 55F and upper-surface drying lamp 56E form a second upper-surface drying unit 54E. The upper-surface drying unit 54E opposes the second lower-surface drying unit 51E of the lower-surface dryer 36B.

With this structure, when the paper sheet 40 is conveyed from the first dryer 35A to the second dryer 35B, air 451, air 452, and air 453 are discharged from discharge holes 431, 432, 433, and 434 in the guide plates 39F to 39J, and air 62 is blown from the upper-surface air blowing devices 55E to 55I. Hence, in the same manner as in the first dryer 35A, the paper sheet 40 is conveyed as it is held levitated at a predetermined height from the guide plates 39F to 39J.

As air 382 is discharged upward from discharge holes 381 in the heat-resistant glass plates 38F to 38J, the paper sheet 40 is lifted by the air 382 and conveyed as it is held levitated at a predetermined height from the guide plates 39F to 39J.

Since the paper sheet 40 does not flap vertically, its trailing edge can be prevented from coming into contact with the heat-resistant glass plates 38F to 38J. Therefore, while the paper sheet 40 is being conveyed in the second dryer 35B, the varnish applied to the lower surface of the paper sheet 40 can be prevented from being removed, or the lower surface of the paper sheet 40 can be prevented from damage. The air 62 blown from air supply ducts 61E to 61I of the upper-surface air blowing devices 55E to 55I is exhausted through the upper exhaust ducts 52 and the exhaust ducts 50 which are located in the widthwise direction.

The air 452 and air 453 are discharged upward from the discharge holes 432 and 433 formed in those regions of the guide plates 39F to 39J which are adjacent to the heat-resistant glass plates 38A to 38E. Even if a gap is formed between the heat-resistant glass plates 38F to 38J and the guide plates 39F to 39J, the paper sheet 40 is lifted by the air 452 and air 453, and its trailing edge can be prevented from coming contact with the guide plates 39F to 39J or the heat-resistant glass plates 38F to 38J.

Discharge holes 434F to 434J for blowing air upward are formed at the central portions of the guide plates 39F to 39J where air discharged from the discharge holes 431 does not flow. Therefore, the central portion of the paper sheet 40 can be prevented from coming into contact with the guide plates 39F to 39J.

The air 451 discharged from the discharge holes 431 in the guide plates 39F to 39J flows in the widthwise direction of the paper sheet 40 and does not toward the heat-resistant glass plates 38F to 38J. Therefore, an air flow that crosses between the guide plates 39F to 39J and heat-resistant glass plates 38F to 38J is not generated. Even if a step is present between the upper surfaces of the heat-resistant glass plates 38F to 38J and the upper surfaces of the adjacent guide plates 39F to 39J, no turbulence is generated between them. Therefore, the paper sheet 40 does not flap vertically, and its trailing edge can be prevented from coming into contact with the guide plates 39F to 39J or heat-resistant glass plates 38F to 38J. As a result, damage to the paper sheet 40 or varnish removal from the paper sheet 40 can be prevented.

The lower-surface drying lamps 46D and 46E promote drying the lower surface of the paper sheet 40 which is being conveyed in this state. Simultaneously, the warm air 451 to warm air 453 discharged from the discharge holes 431 to 434 in the guide plate 39G of the second lower-surface drying unit 51E also dry the lower surface of the paper sheet 40. Thus, the non-dry portion which is not dried by the lower-surface dryer 36A of the first dryer 35A is dried.

The second guide plate 39G is heated by the upper-surface drying lamp 56E opposing it. The heated guide plate 39G further promotes drying the lower surface of the paper sheet 40. In this case, the room-temperature air 451 discharged from the discharge holes 431 in the first guide plate 39F cools the lower surface of the paper sheet 40 which is heated by the warm air 451 to warm air 453 discharged from the discharge holes 431 to 434 in the guide plates 39D and 39E which are located more upstream of the guide plate 39F in the sheet convey direction.

The room-temperature air 451 to room-temperature air 453 discharged from the discharge holes 431 to 434 in the third to fifth guide plates 39H to 39J cool the lower surface of the paper sheet 40 which is heated by the warm air 451 to warm air 453 discharged from the discharge holes 431 to 434 in the guide plate 39G located on the upstream side in the sheet convey direction and by the lower-surface drying lamps 46D and 46E. Thus, hardening of the paper sheet 40 due to excessive heat to the lower surface of the paper sheet 40 and hardening of the ink or varnish applied to the paper sheet 40 can be prevented.

The upper surface of the paper sheet 40 is promoted to be dried by the upper-surface drying lamps 56D and 56E. Simultaneously, the upper surface of the paper sheet 40 is dried by the warm air 62 blown from the upper-surface air blowing device 55F, to dry the non-dry portion that has not been dried by the upper-surface dryer 37A of the first dryer 35A.

In this case, the room-temperature air 62 discharged from the first upper-surface air blowing device 55E cools the upper surface of the paper sheet 40 which is heated by the warm air 62 discharged from the upper-surface air blowing device 55D located on the upstream side in the sheet convey direction.

The room-temperature air 62 discharged from the third to fifth upper-surface air blowing devices 55G, 55H, and 55I cools the upper surface of the paper sheet 40 which is heated by the warm air 62 discharged from the upper-surface air blowing device 55F located on the upstream side in the sheet convey direction and the upper-surface drying lamps 56D and 56E. Thus, hardening of the paper sheet 40 due to excessive heat to the upper surface of the paper sheet 40 and hardening of the ink or varnish coated to the paper sheet 40 can be prevented.

In the lower-surface dryer 36B of the second dryer 35B, although lower-surface drying lamps are not arranged in the third to fifth chambers 461 from the upstream side in the convey direction of the paper sheet 40, one may be arranged if necessary.

Figure 3B:
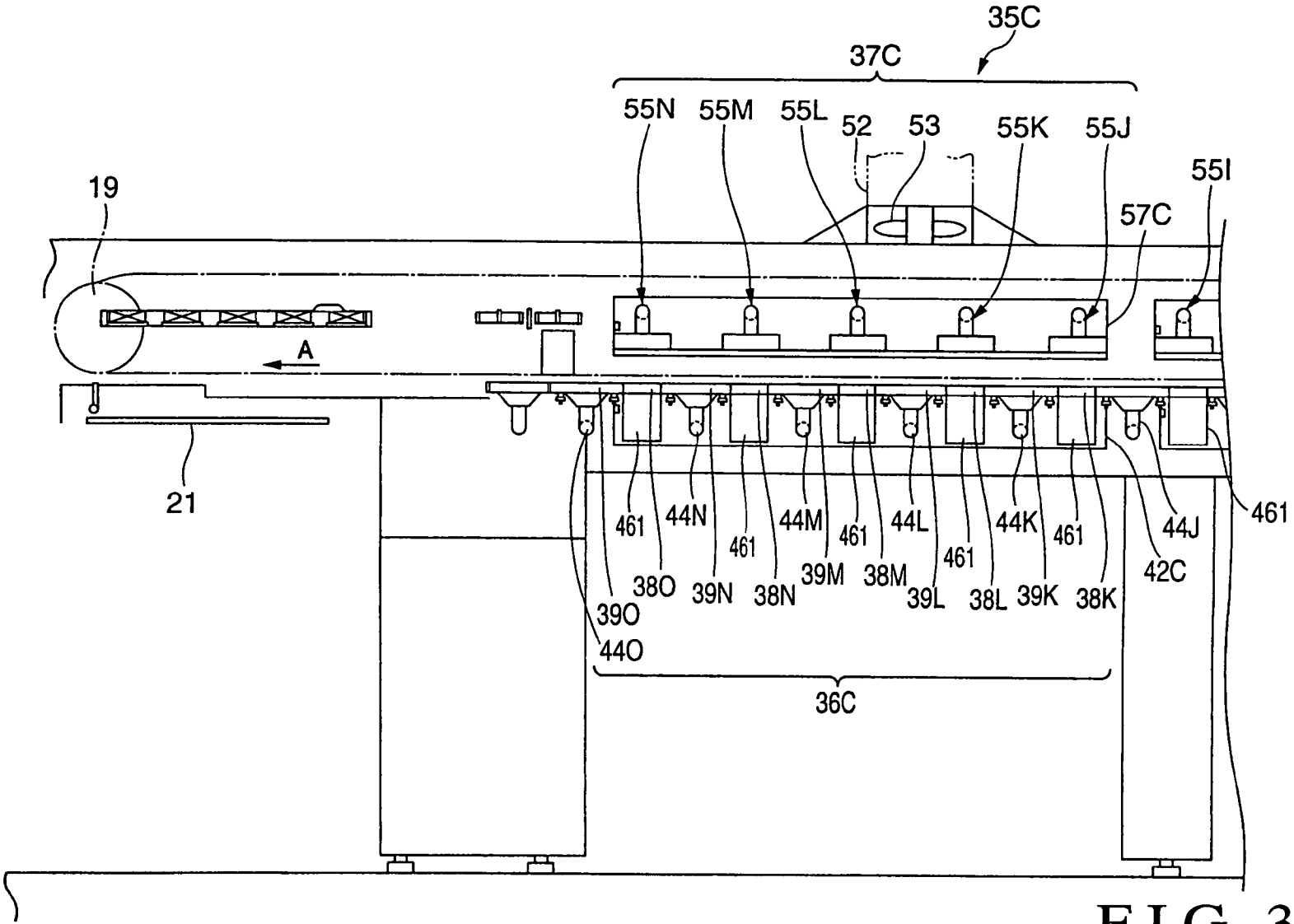

The third dryer 35C will be described with reference to FIG. 3B. The third dryer 35C includes a lower-surface dryer 36C which is arranged under the convey path 20 of the paper sheet 40, and an upper-surface dryer 37C which is arranged above the convey path 20 of the paper sheet 40 to oppose the lower-surface dryer 36C.

The lower-surface dryer 36C has five heat-resistant glass plates 38K to 38O and five guide plates 39K to 39O which are alternately arranged in the convey direction (the direction of the arrow A) of the paper sheet 40. The heat-resistant glass plates 38K to 38O and guide plates 39K to 30O are attached to support members 42C fixed to the pair of frames 41. Ducts 44K to 44O which supply air are connected to the guide plates 39K to 39O. Room-temperature air from the lower-surface blower 49 is supplied to the ducts 44K to 44O.

In the upper-surface dryer 37C, five upper-surface air blowing devices 55J to 55N respectively opposing the heat-resistant glass plates 38K to 38O of the lower-surface dryer 36C are attached between the pair of frames 41 through support members 57C. Room-temperature air from the upper-surface blower 58 is supplied to the upper-surface air blowing devices 55J to 55N.

In this structure, when the paper sheet 40 is conveyed from the second dryer 35B to the third dryer 35C, air 451, air 452, and air 453 are discharged from discharge holes 431, 432, 433, and 434 in the guide plates 39K to 39O, and air 62J to air 62N are blown from the upper-surface air blowing devices 55J to 55N. Hence, in the same manner as in the first dryer 35A, the paper sheet 40 is conveyed as it is held levitated at a predetermined height form the guide plates 39K to 39O.

As air 382 is discharged upward from the discharge holes 381 in the heat-resistant glass plates 38K to 38O, the paper sheet 40 is lifted by the air 382 and conveyed as it is held levitated at a predetermined height from the guide plates 39K to 39O.

Since the paper sheet 40 does not flap vertically, its trailing edge can be prevented from coming into contact with the heat-resistant glass plates 38K to 38O. Therefore, while the paper sheet 40 is being conveyed in the third dryer 35C, the varnish applied to the lower surface of the paper sheet 40 can be prevented from being removed, or the lower surface of the paper sheet 40 can be prevented from being damaged. Air 62 blown from air supply ducts 61J to 61N of the upper-surface air blowing devices 55J to 55N is exhausted through upper exhaust ducts 52 and exhaust ducts 50 which are located in the widthwise direction.

The discharge holes 431 and 433 are formed in those regions of the guide plates 39K to 39O which are adjacent to the heat-resistant glass plates 38K to 38O, and the air 452 and air 453 are discharged upward from the discharge holes 431 and 433. Even if a gap is formed between the heat-resistant glass plates 38K to 38O and the guide plates 39K to 39O, the paper sheet 40 is lifted by the air 452 and air 453, and its trailing edge can be prevented from coming contact with the guide plates 39K to 39O or the heat-resistant glass plates 38K to 38O.

The discharge holes 434 for blowing air upward are formed at the central portions of the guide plates 39K to 39O where air from the discharge holes 431 does not flow. Therefore, the central portion of the paper sheet 40 can be prevented from coming into contact with the guide plates 39K to 39O.

The air 451 discharged from the discharge holes 431 in the guide plates 39K to 39O flows in the widthwise direction of the paper sheet 40 and does not toward the heat-resistant glass plates 38K to 38O. Therefore, an air flow that crosses between the guide plates 39K to 39O and heat-resistant glass plates 38K to 38O is not generated. Even if a step is present between the upper surfaces of the heat-resistant glass plates 38K to 38O and the upper surfaces of the adjacent guide plates 39K to 39O, no turbulence is generated between them. Therefore, the paper sheet 40 does not flap vertically, and its trailing edge can be prevented from coming into contact with the guide plates 39K to 39O or heat-resistant glass plates 38K to 38O. As a result, damage to the paper sheet 40 or varnish removal from the paper sheet 40 can be prevented.

In the third dryer 35C, no drying lamps are arranged in the chambers 461, and the temperatures of the air 451, air 452, and air 453 discharged from the discharge holes 431, 432, 433, and 434 in the guide plates 39K to 39O are set to room temperature. The temperature of the air 62 blown from the upper-surface air blowing devices 55J to 55N is also set to room temperature. Thus, the dryer 35C does not have the function of drying the upper and lower surfaces of the paper sheet 40, but conveys and cools the paper sheet 40.

Drying lamps may be arranged in the respective chambers 461 of the lower-surface dryer 36C. As the third dryer 35C can be formed such that it can be used as a dryer as well when necessary, it serves as a spare dryer.

A sheet dryer according to the second embodiment of the present invention will be described with reference to FIGS. 10A and 10B.

Figure 10A:
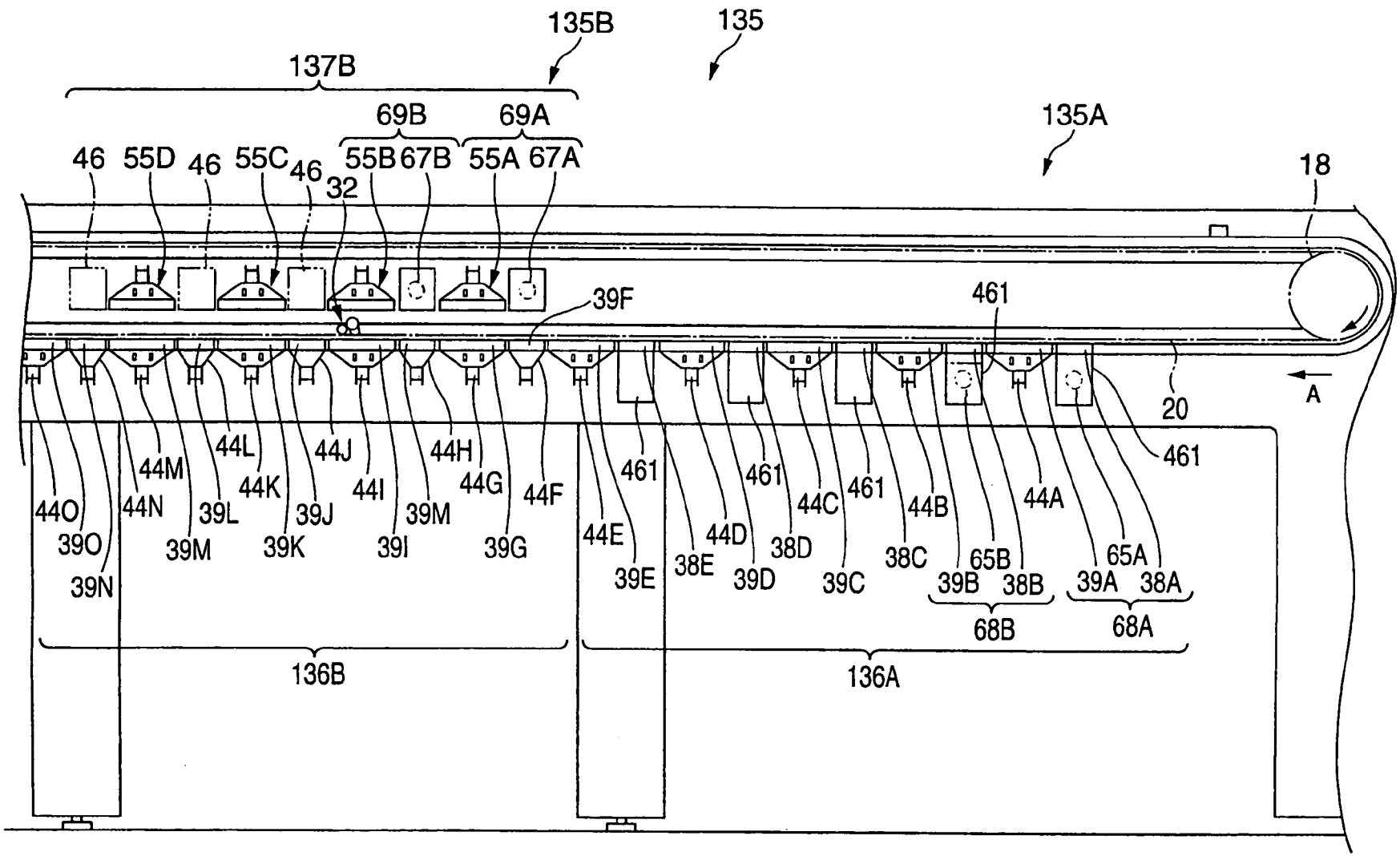
FIGS. 10A and 10B are side views showing the upstream and downstream halves, respectively, of a sheet dryer according to the second embodiment of the present invention.
Figure 10B:
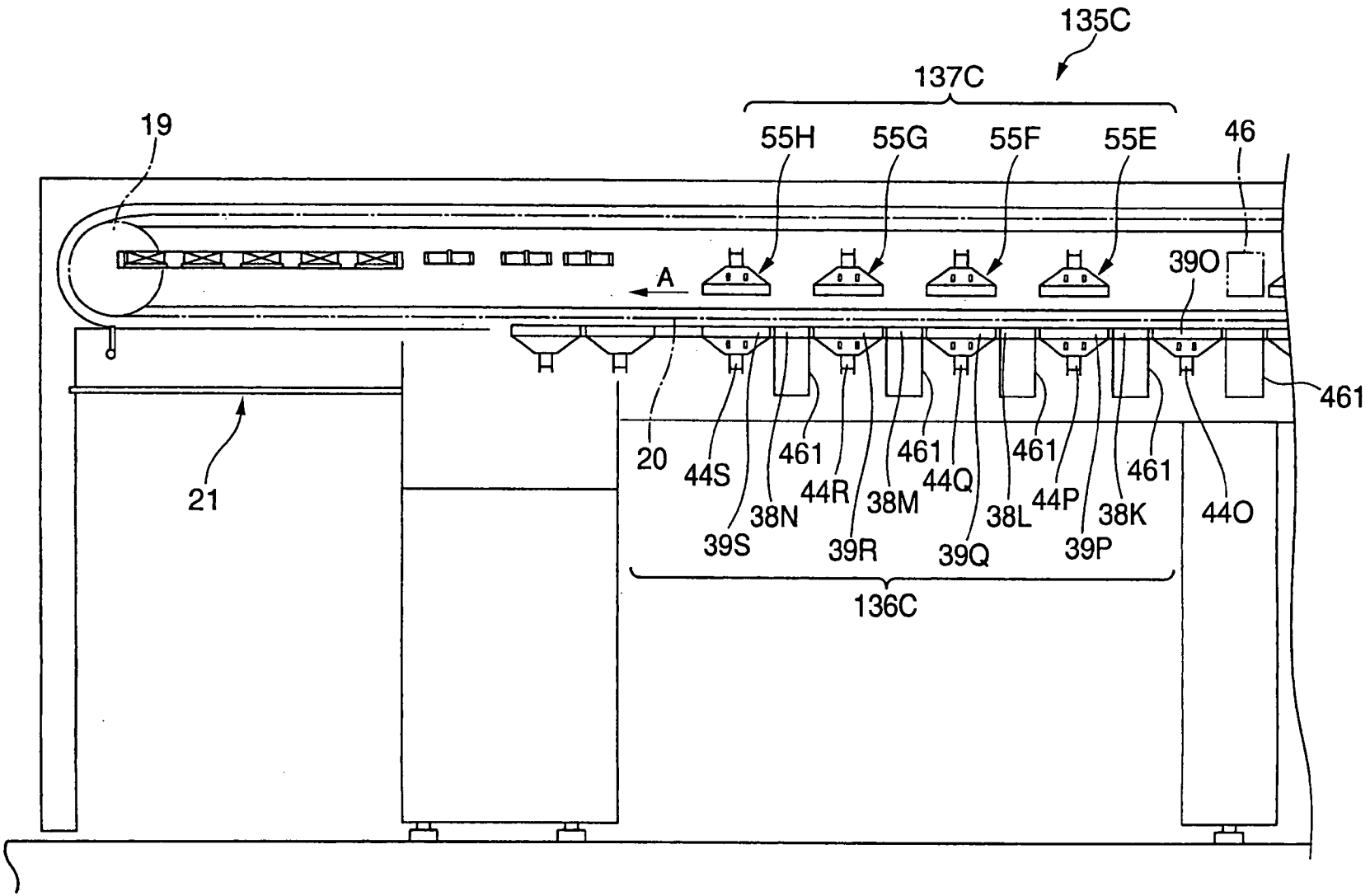

Referring to FIGS. 10A and 10B, a drying device 135 includes first to third dryers 135A, 135B, and 135C which are sequentially positioned from the upstream side toward the downstream side in the sheet convey direction (a direction of an arrow A). According to this embodiment, no upper-surface dryer is provided but only a lower-surface dryer 136A is provided to the first dryer 135A.

The lower-surface dryer 136A of the first dryer 135A has five heat-resistant glass plates 38A to 38E and five guide plates 39A to 39E which are alternately arranged in the convey direction (the direction of the arrow A) of a paper sheet 40 and have the same structure as that of the first embodiment. Five chambers 461 having the same structure as that of the first embodiment are arranged under the heat-resistant glass plates 38A to 38E. Room-temperature air from a lower-surface blower 49 is supplied to the chambers 461. Lower-surface drying lamps 65A and 65B formed of ultraviolet lamps are arranged in the first and second chambers 461 from the upstream side in the convey direction of the paper sheet 40.

The room-temperature air from the lower-surface blower 49 is supplied to ducts 44A to 44E which supply air to the guide plates 39A to 39E. When seen from the upstream side in the sheet convey direction, the lower-surface drying lamp 65A, heat-resistant glass plate 38A, and guide plate 39A form a first lower-surface drying unit 68A. The lower-surface drying lamp 65B, heat-resistant glass plate 38B, and guide plate 39B form a second lower-surface drying unit 68B.

The second dryer 135B includes a lower-surface dryer 136B which is arranged under a convey path 20 of the paper sheet 40 and has no drying lamps, and an upper-surface dryer 137B which is arranged above the 20 convey path of the paper sheet 40 to oppose the lower-surface dryer 136B and has drying lamps.

In the lower-surface dryer 136B, ten guide plates 39F to 39O having the same structure as that of the first embodiment are arranged in the convey direction (the direction of the arrow A) of the paper sheet 40. The room-temperature air from the lower-surface blower 49 is supplied to ten ducts 44F to 44O which supply air to the guide plates 39F to 39O. The ducts 44F to 44O, guide plates 39F to 39O, and lower-surface blower 49 correspond to the lower-surface air blowing devices of the present invention.

The upper-surface dryer 137B has two upper-surface drying lamps 67A and 67B formed of ultraviolet lamps, and four upper-surface air blowing devices 55A and 55D. The upper-surface drying lamps 67A and 67B respectively oppose the first and second guide plates 39F and 39G of the lower-surface dryer 136B. The upper-surface air blowing devices 55A to 55D respectively oppose the guide plates 39G, 39I, 39K, and 39M of the lower-surface dryer 136B. Normal-air temperature from an upper-surface blower 58 is supplied to the upper-surface air blowing devices 55A to 55D.

When seen from the upstream side in the sheet convey direction, the upper-surface drying lamp 67A and upper-surface air blowing device 55A form a first upper-surface drying unit 69A. The upper-surface drying lamp 67B and upper-surface air blowing device 55B form a second upper-surface drying unit 69B.

As shown in FIG. 10B, the third dryer 135C includes a lower-surface dryer 136C which is arranged under the convey path 20 of the paper sheet 40, and an upper-surface dryer 137C which is arranged above the convey path 20 of the paper sheet 40 to oppose the lower-surface dryer 136C and has no drying lamps.

The lower-surface dryer 136C has four heat-resistant glass plates 38K to 38N and four guide plates 39P to 39S which are arranged alternately in the convey direction (the direction of the arrow A) of the paper sheet 40 and have the same structure as that of the first embodiment. Four chambers 461 having the same structure as that of the first embodiment are arranged under the heat-resistant glass plates 38K to 38N. Room-temperature air from a second lower-surface blower 49 is supplied to the four chambers 461. Room-temperature air from a third lower-surface blower (not shown) is supplied to four ducts 44P to 44S which supply air to the guide plates 39P to 39S.

The upper-surface dryer 137C has four upper-surface air blowing devices 55E to 55H respectively oppose the guide plates 39P to 39S of the lower-surface dryer 136C. Room-temperature air from a third upper-surface blower is supplied to the upper-surface air blowing devices 55E to 55H. The third upper-surface blower can supply both the room-temperature air and low-temperature air which is cooled by a cooling device.

In this structure, the paper sheet 40 which is conveyed into the first dryer 135A by the delivery chain 20 is conveyed as it is levitated from the guide plates 39A to 39E and heat-resistant glass plates 38A to 38E by air 451, air 452, and air 453 which are discharged from discharge holes 431, 432, 433, and 434 in the guide plates 39A to 39E and air 382 which is discharged from discharge holes 381 in the heat-resistant glass plates 38A to 38E. Thus, while the paper sheet 40 is being conveyed in the first dryer 135A, it does not come into contact with the guide plates 39A to 39E or heat-resistant glass plates 38A to 38E. Thus, removal of varnish applied to the lower surface of the paper sheet 40 or damage to the lower surface of the paper sheet 40 can be prevented.

In this manner, the lower surface of the paper sheet 40 which is being conveyed in the first dryer 135A is irradiated with ultraviolet rays from the lower-surface drying lamps 65A to 65B to promote chemical reaction there, so that the varnish applied to the lower surface of the paper sheet 40 is hardened and dried. If drying with infrared rays becomes necessary in addition to drying with the ultraviolet rays, infrared lamps may be arranged in the chambers 461 which are on the upstream side in the convey direction of the paper sheet 40 and correspond to the third to fifth guide plates 39C to 39E.

When the paper sheet 40, the lower surface of which is dried in the first dryer 135A, is conveyed into the second dryer 135B, it is conveyed as it is levitated from the guide plates 39F to 39O, in the same manner as in the first dryer 35A of the first embodiment described above. While the paper sheet 40 is being conveyed in the second dryer 135B, removal of the varnish applied to the lower surface of the paper sheet 40 or damage to the lower surface of the paper sheet 40 can be prevented.

In this state, the upper surface of the paper sheet 40 which is being conveyed in the second dryer 135B is irradiated with the ultraviolet rays from the upper-surface drying lamps 67A to 67B to promote chemical reaction there, so that the varnish applied to the upper surface of the paper sheet 40 is hardened and dried. If drying with infrared rays becomes necessary in addition to drying with the ultraviolet rays, an infrared lamp 46 may be arranged more downstream of the second to fourth upper-surface air blowing devices 55B to 55D in the convey direction of the paper sheet 40, as indicated by an alternate long and two short dashed line.

When the paper sheet 40 is conveyed from the second dryer 135B to the third dryer 135C, it is conveyed as it is levitated at a predetermined height from the heat-resistant glass plates 38K to 38N and guide plates 39P to 39S, in the same manner as in the third dryer 35C of the first embodiment described above. While the paper sheet 40 is being conveyed in the third dryer 135C, it does not come into contact with the heat-resistant glass plates 38K to 38N or guide plates 39P to 39S. Thus, removal of the varnish coated to the lower surface of the paper sheet 40 or damage to the lower surface of the paper sheet 40 can be prevented.

In the third dryer 135C, no drying lamps are provided, and the temperatures of air 451 to air 453 discharged from discharge holes 431 to 434 in the guide plates 39P to 39S are set to room temperature. The temperature of air 62 blown from the upper-surface air blowing devices 55E to 55H is also set to room temperature. Hence, the third dryer 135C does not have the function of drying the upper and lower surfaces of the paper sheet 40, and merely conveys it.

In the third dryer 135C, when the paper sheet 40 must be cooled, cooled low-temperature air from a third lower-surface blower (not shown) is supplied to the guide plates 39P to 39S, and the low-temperature air 451 to air 453 discharged from the discharge holes 431 to 434 are blown to the lower surface of the paper sheet 40.

Simultaneously, the cooled low-temperature air from the third upper-surface blower is supplied to the upper-surface air blowing devices 55E to 55H, and the cooled low-temperature air 62 from the upper-surface air blowing devices 55E to 55H is blown to the upper surface of the paper sheet 40.

Figure 11:
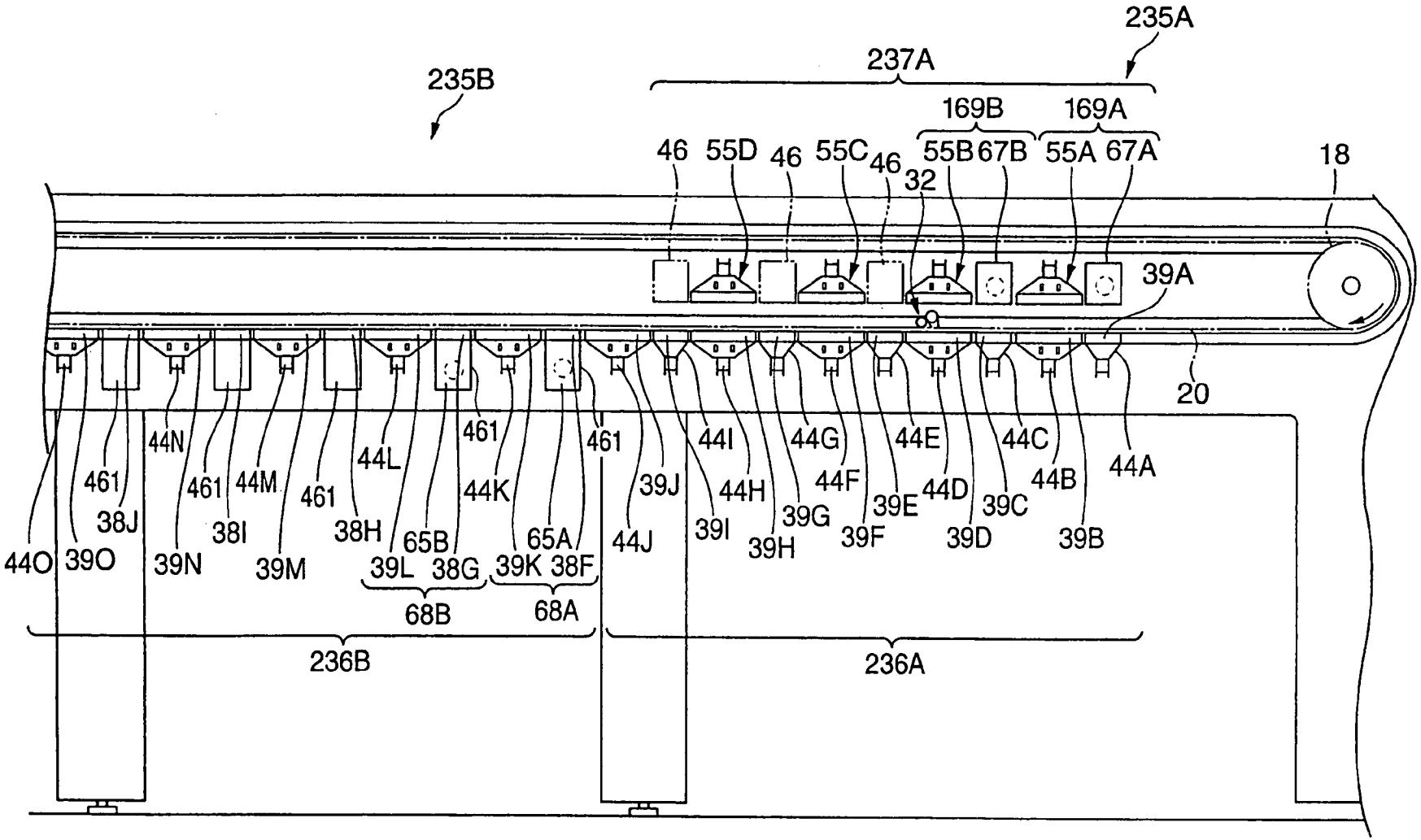
FIG. 11 is a side view showing the upstream half of a sheet dryer according to the third embodiment of the present invention.

A sheet dryer according to the third embodiment of the present invention will be described with reference to FIG. 11. FIG. 11 shows the upstream half of a drying device in a sheet-fed offset rotary printing press. In this embodiment, no upper-surface dryers are provided but only lower-surface dryers are provided to a second dryer 235B.

A first dryer 235A includes a lower-surface dryer 236A which is arranged under a convey path 20 of a paper sheet 40 and has no drying lamps, and an upper-surface dryer 237A which is arranged above the convey path 20 of the paper sheet 40 to oppose the lower-surface dryer 236A and has drying lamps. The lower-surface dryer 236A corresponds to the lower-surface air blowing device of the present invention.

The lower-surface dryer 236A has, in the convey direction (a direction of an arrow A) of the paper sheet 40, ten guide plates 39A to 39J which have the same structure as that of the first embodiment. Room-temperature air from a lower-surface blower 49 is supplied to ten ducts 44A to 44J which supply air to the guide plates 39A to 39J.

The upper-surface dryer 237A has two upper-surface drying lamps 67A and 67B formed of ultraviolet lamps, and four upper-surface air blowing devices 55A to 55D. The upper-surface drying lamps 67A and 67B respectively oppose first and second heat-resistant glass plates 38A and 38B of the lower-surface dryer 236A.

The upper-surface air blowing devices 55A to 55D respectively oppose the guide plates 39B, 39D, 39F, and 39H of the lower-surface dryer 236A. Room-temperature air from an upper-surface blower 58 is supplied to the upper-surface air blowing devices 55A to 55D. When seen from the upstream side in the sheet convey direction, the upper-surface drying lamp 67A and upper-surface air blowing device 55A form a first upper-surface drying unit 169A. The upper-surface drying lamp 67B and upper-surface air blowing device 55B form a second upper-surface drying unit 169B.

A lower-surface dryer 236B of the second dryer 235B has five heat-resistant glass plates 38F to 38J and five guide plates 39K to 39O which are arranged alternately in the convey direction (the direction of the arrow A) of the paper sheet 40 and have the same structure as that of the first embodiment. Five chambers 461 having the same structure as that of the first embodiment are arranged under the heat-resistant glass plates 38F to 38J. The room-temperature air from the lower-surface blower 49 is supplied to the chambers 461. Two lower-surface drying lamps 65A and 65B formed of ultraviolet lamps are arranged in the first and second chambers 461 from the upstream side in the convey direction of the paper sheet 40.

The room-temperature air from the lower-surface blower 49 is supplied to five ducts 44K to 44O which supply air to the guide plates 39K to 39O. When seen from the upstream side in the sheet convey direction, the lower-surface drying lamp 65A, heat-resistant glass plate 38F, and guide plate 39K form a first lower-surface drying unit 68A. The lower-surface drying lamp 65B, heat-resistant glass plate 38G, and guide plate 39L form a second lower-surface drying unit 68B.

In this structure, the paper sheet 40 which is conveyed into the first dryer 235A by the delivery chain 20 is conveyed as it is levitated from the guide plates 39A to 39J, in the same manner as in the second dryer 135B of the second embodiment. While the paper sheet 40 is being conveyed in the first dryer 235A, it does not come into contact with the guide plates 39A to 39J. Thus, removal of varnish applied to the lower surface of the paper sheet 40 or damage to the lower surface of the paper sheet 40 can be prevented.

In this state, the upper surface of the paper sheet 40 which is being conveyed in the first dryer 235A is irradiated with ultraviolet rays from the upper-surface drying lamps 67A and 67B to promote chemical reaction there. Thus, the varnish applied to the upper surface of the paper sheet 40 is hardened and dried.

The paper sheet 40 which is conveyed from the first dryer 235A into the second dryer 235B is conveyed as it is levitated from the guide plates 39K to 39O and heat-resistant glass plates 38F to 38J, in the same manner as in the first dryer 135A of the second embodiment. While the paper sheet 40 is being conveyed in the second dryer 235B, it does not come into contact with the guide plates 39K to 39O or heat-resistant glass plates 38F to 38J. Thus, removal of the varnish applied to the lower surface of the paper sheet 40 or damage to the lower surface of the paper sheet 40 can be prevented.

In this manner, the lower surface of the paper sheet 40 which is being conveyed in the second dryer 235B is irradiated with the ultraviolet rays from the lower-surface drying lamps 65A to 65B to promote chemical reaction there. Thus, the varnish applied to the lower surface of the paper sheet 40 is hardened and dried.

While the embodiments described above exemplify a sheet-fed offset rotary printing press, the present invention can also be applied to a stand-alone coating apparatus. While the drying device 35, 135, or 235 dries the varnish applied to the two surfaces of the paper sheet 40, the present invention can also be applied to a case wherein only ink is to be dried. In the first dryer 35A, the lower-surface dryer 36A is provided with the three lower-surface drying units 51A, 51B, and 51C, and the upper-surface dryer 37A is provided with the three upper-surface drying units 54A, 54B, and 54C. It suffices as far as the lower-surface dryer 36A is provided with at least one lower-surface drying unit and the upper-surface dryer 37A is provided with at least one upper-surface drying unit.

Similarly, in the second dryer 35B, the lower-surface dryer 36B is provided with the two lower-surface drying units 51D and 51E, and the upper-surface dryer 37B is provided with the two upper-surface drying units 54D and 54E. It suffices as far as the lower-surface dryer 36B is provided with at least one lower-surface drying unit and the upper-surface dryer 37B is provided with at least one upper-surface drying unit. In the second embodiment, the lower-surface dryer 136A is provided with the two lower-surface drying units 68A and 68B, and the upper-surface dryer 137B is provided with the two upper-surface drying units 69A and 69B. In the third embodiment, the lower-surface dryer 236B is provided with the two lower-surface drying units 68A and 68B, and the upper-surface dryer 237A is provided with the two upper-surface drying units 169A and 169B. It suffices as far as the lower-surface dryer and upper-surface dryer are respectively provided with at least one lower-surface drying unit and at least one upper-surface drying unit.

In the first embodiment, the drying lamps are formed of infrared lamps. Alternatively, ultraviolet lamps may be employed. In this case, the temperatures of air supplied from the lower-surface blower 47 and upper-surface blower 57 may be set to room temperature. In that case, the lower-surface blower 47 or upper-surface blower 57 need not be provided, but only the upper-surface blower 58 and lower-surface blower 49 may be used. In the second and third embodiments, the drying lamps are formed of ultraviolet lamps. Alternatively, infrared lamps may be used. In this case, the temperatures of air supplied from the third lower-surface blower and upper-surface blower may be set to a combination of room temperature and a high temperature.

As has been described above, according to the present invention, when the sheet which is conveyed by the convey means passes above the guide plate, the lower surface of the sheet is dried by the lower-surface drying lamp as it is levitated by air discharged in the widthwise direction of the sheet. The transparent plate arranged above the lower-surface drying lamp has first discharge holes through which air is discharged upward. Hence, an air layer which moves the sheet upward is formed above the transparent plate provided alternately with the guide plate. Thus, the sheet is prevented from coming into contact with the guide plate or transparent plate, and removal of the varnish applied to the lower surface of the sheet or damage to the lower surface of the sheet can be prevented.

Air which is discharged upward from the discharge holes formed in those regions of the guide plate which are adjacent to the transparent plate can prevent air turbulence which is generated by a step or a gap between the guide plate and transparent plate. Thus, the sheet under conveyance does not flap or wave to come into contact with the guide plate or transparent plate. Thus, removal of the varnish applied to the lower surface of the sheet or damage to the lower surface of the sheet can be prevented.

The lower surface of the sheet can be dried by air discharged from the second and third discharge holes. Also, the upper and lower surfaces of the sheet can be dried by the air. As the guide plate is heated by the upper-surface drying lamp, the lower surface of the sheet is more promoted to be dried. Also, the upper surface of the sheet can be dried by air discharged from the upper-surface air blowing device.

What is claimed is:

1. A sheet dryer comprising:

convey means for conveying a sheet along a convey path;

at least one transparent plate which is arranged under said sheet convey path;

at least one lower-surface drying lamp which is arranged under said transparent plate and dries a lower surface of the printed/coated sheet;

a guide plate which is arranged adjacent to said transparent plate in a sheet convey direction;

a plurality of first discharge holes which are formed in said transparent plate and through which air is discharged upward; and a plurality of second discharge holes which are formed in said guide plate and through which air is discharged in a widthwise direction of the sheet.

2. A dryer according to claim 1, further comprising a third discharge hole which is formed in a region of said guide plate which is adjacent to said transparent plate and through which air is discharged upward.

3. A dryer according to claim 2, wherein said guide plate is arranged adjacent to said transparent plate on an upstream side in the sheet-like object convey direction.

4. A dryer according to claim 3, wherein warm air is discharged from the second and third discharge holes.

5. A dryer according to claim 2, further comprising a fourth discharge hole which is formed in a central region of said guide plate in a widthwise direction of the sheet and through which air is discharged.

6. A dryer according to claim 1, further comprising an upper-surface drying lamp which is arranged above said sheet convey path and dries an upper surface of the sheet.

7. A dryer according to claim 6, wherein said upper-surface drying lamp is arranged to oppose said guide plate through said sheet convey path.

8. A dryer according to claim 6, further comprising an upper-surface air blowing device which is arranged adjacent to said upper-surface drying lamp on an upstream side in the sheet convey direction and blows out warm air.

9. A dryer according to claim 1, wherein said transparent plate, lower-surface drying lamp, and guide plate form a lower-surface drying unit.

10. A dryer according to claim 9, further comprising:

a lower-surface air blowing device which is arranged under said sheet convey path and discharges air toward a lower surface of the sheet on a downstream side of said lower-surface drying unit in the sheet convey direction; and an upper-surface drying unit which is arranged to oppose said lower-surface air blowing device through said sheet convey path and dries an upper surface of the sheet.

11. A dryer according to claim 9, further comprising:

a lower-surface air blowing device which is arranged under said sheet convey path and discharges air toward a lower surface of the sheet on an upstream side of said lower-surface drying unit in the sheet convey direction; and an upper-surface drying unit which is arranged to oppose said lower-surface air blowing device through said sheet convey path and dries an upper surface of the sheet.

12. A dryer according to claim 1, wherein said lower-surface drying lamp comprises one of an infrared lamp and ultraviolet lamp, when said lower-surface drying lamp comprises an infrared lamp, warm air is discharged from the first and second discharge holes, and when said lower-surface drying lamp comprises an ultraviolet lamp, room-temperature air is discharged from the first and second discharge holes.

13. A dryer according to claim 1, wherein first and second sets each including said transparent plate and guide plate are sequentially arranged from an upstream side of the sheet along said sheet convey path, warm air is discharged from the second discharge holes in said guide plate of said first set, and room-temperature air is discharged from the second discharge holes in said guide plate of said second set and the first discharge holes in said transparent plate of each of said first and second sets.

14. A dryer according to claim 1, further comprising exhaust means for exhausting the air discharged from the first and second discharge holes outside said sheet convey path.

15. A dryer according to claim 14, wherein said exhaust means comprises a first exhaust duct which is arranged in the vicinity of each of two ends of said guide plate in a direction perpendicular to the sheet convey direction, and a second exhaust duct which is arranged above said sheet convey path.

16. A dryer according to claim 1, wherein air that has cooled said lower-surface drying lamp is discharged from the first discharge holes.

17. A dryer according to claim 16, further comprising:

a chamber which includes a box with an upper opening and said transparent plate attached to cover the opening of said box and accommodates said lower-surface drying lamp, and an exhaust port which is formed in one wall of said chamber in the sheet convey direction, wherein air exhausted from the discharge port is discharged from the first discharge holes.

* * * * *